US005992207A

United States Patent [19]

Hofele et al.

[11] Patent Number: 5,992,207

[45] Date of Patent: Nov. 30, 1999

[54] MULTISTATION PRESS FOR FORMING SHEET METAL PARTS

[75] Inventors: Hans Hofele, Göppingen; Martin Schmeink, Süsssen, both of Germany

[73] Assignee: Schuler Pressen GmbH & Co., Goeppingen, Germany

[21] Appl. No.: 09/109,868

[22] Filed: Jul. 6, 1998

[30] Foreign Application Priority Data

Jul. 3, 1997 [DE] Germany ..... 197 28 361

[51] Int. Cl.[6] ..... B21D 43/05

[52] U.S. Cl. ..... 72/405.01; 72/455; 100/207

[58] Field of Search ..... 72/405.01, 404, 72/455, 472; 100/207, 214

[56] References Cited

U.S. PATENT DOCUMENTS

| | | | |
|---|---|---|---|
| 3,724,364 | 4/1973 | Munch | 100/214 |
| 3,779,155 | 12/1973 | Ohno | 100/207 |
| 5,375,513 | 12/1994 | Michael et al. | 100/207 |
| 5,551,275 | 9/1996 | Hofele | 72/455 |
| 5,582,063 | 12/1996 | Hofele | 72/455 |
| 5,595,111 | 1/1997 | Michael et al. | 72/405.01 |

FOREIGN PATENT DOCUMENTS

| | | |
|---|---|---|
| 0590358 | 4/1994 | European Pat. Off. . |
| 3322377 | 1/1985 | Germany . |

*Primary Examiner*—Daniel C. Crane
*Attorney, Agent, or Firm*—Evenson, McKeown, Edwards & Lenahan, P.L.L.C.

[57] ABSTRACT

In a large-part transfer press, several forming stations are arranged below a common slide in order to minimize cost. The bedplate construction has two longitudinal or basic supports. On each support, one bedplate per forming station is transversely placed and fastened as required. Driving of the slide takes place by two mutually independent head pieces which, depending on the number of stations, are arranged side-by-side at a distance. Each of the head pieces spans only one forming station.

19 Claims, 3 Drawing Sheets

MULTISTATION PRESS FOR FORMING SHEET METAL PARTS

This application claims the priority of Application No. 197 28 361.6, filed in Germany on Jul. 3, 1997, the disclosure of which is expressly incorporated by reference herein.

BACKGROUND AND SUMMARY OF THE INVENTION

One object of this invention is to provide a particular multistation press for producing relatively large vehicle body parts.

Multistation presses of this type have press stations in which forming tools (consisting of a top tool and a bottom tool) are arranged. During operation, the sheet metal parts are transferred from press station to press station in order to be formed step-by-step. While the first press station is usually a drawing station, in which a relatively pronounced workpiece deformation takes place, the dimensional changes in the press stations which follow are usually much less pronounced. The forces required for this purpose act correspondingly.

Multistation presses with separate, mutually linked press stations, if they are set up for machining relatively large sheet metal parts, have very large dimensions and are therefore correspondingly expensive. It is an object of this invention to minimize the space required for the press as well as costs.

As described in German Patent Document DE 42 21 143 A1, this has been attempted by constructionally combining the press stations which follow the drawing station. For this purpose, the press frame is constructed on two transversely arranged main supports on which a bedplate is placed in the passage direction which spans two work stations. Bottom tools assigned to the individual work stations are arranged on the bedplate arranged in the longitudinal direction. Above the bedplate, two press slides, which are arranged behind one another in the longitudinal direction, are held so that they can be moved up and down and are driven in an up-and-down swinging manner by respective separate head pieces. The head pieces are disposed on longitudinal traverses which extend continuously on the right and the left side and which, in turn, are set up by a total of four press stands on the cross traverses which extend below the bedplate.

The longitudinally extending bedplate, which is disposed at its forward and rearward end, as well as the longitudinally extending traverses which carry the head pieces, results in a very heavy construction, particularly if the press is to machine relatively large sheet metal parts and therefore itself has relatively large dimensions.

From European Patent Document EP 0 581 008 A2, a similar press system is known having press stations following the drawing station which are serviced by a common slide. In this slide, which is an exterior slide, so-called interior slides are disposed in a vertically displaceable manner and can be adjusted separately.

In this press system, which uses the same basic concept as the previously described press system, in the case of relatively large press dimensions, the required stabilities of the supports extending in the longitudinal direction and of the longitudinally arranged bedplate can be achieved only by using large amounts of material.

From German Patent Document DE 33 22 377 A1, a multistation press which has a press frame that has several so-called upper stand parts which are set up on a bedplate extending in the longitudinal direction and by which two platforms are carried which extend in the longitudinal direction is known. The platforms form longitudinal supports between which two head pieces are held for driving the slides arranged underneath.

Concerning the press frame, the statements apply which were made in conjunction with the above-mentioned state of the art.

From German Patent Document DE 42 32 604 A1, a multistation press is known in which press frame with several slides of different lengths are disposed behind one another in the longitudinal direction. A separate bedplate and an individual head piece is assigned to each slide, with the head piece and the bedplate extending along the whole length of the slide. If the slide is to span several press stations, for the above-mentioned reasons, then an unacceptably high press weight and manufacturing expenditures will result.

SUMMARY OF THE INVENTION

Based on the above, it is one object of the invention to provide a multistation press which can be established at low expenditures even if it is set up for machining relatively large sheet metal parts.

This object is achieved by a particular multistation press for forming sheet metal parts for a vehicle body. The press includes at least one common and continuous slide extending in a passage direction among at least two press stations and disposed to move back and forth, and a press frame in which the at least one slide is driven and including at least one stand portal which has at least one head piece and press stands which carry the at least one head piece and which bear and guide the slide. The at least one head piece is carried by the press stands and is used for driving the slide with a back-and-forth movement. The press frame further includes two basic supports which carry at least one bedplate arranged below the slide and used for receiving tools as well as the press stands. The basic supports are arranged along the passage direction at a distance, parallel to one another, and extending along a whole length of the press stations to which the slide is assigned. The slide is carried by at least two stand portals which are disposed independently of one another on the basic supports. Each of the portals has a head piece which drives the slide, and each of the head pieces operates synchronously with respect to one another.

In contrast to known multistation presses, the multistation press according to the invention has two longitudinal supports spaced in parallel to one another as supporting elements under the slide extending along several press stations. Bedplates may be disposed on these longitudinal supports separately in each press station, which bedplates will then only span the width of the press but not the overall length of the press stations spanned by the slide. As a result, the bedplates are smaller and easier to handle and by themselves must be designed to be less resistant to bending. The longitudinal supports resulting in the required resistance to bending are disposed in a stationary manner and are arranged laterally so that, as an additional advantage, a free passage exists under the bedplates approximately at the press center in the passage direction. For example, a device for removing punchings can be arranged here. No transverse support blocks the path here.

Independently of one another, two stand portals are erected on the longitudinal or basic supports, each carrying a head piece with a slide drive. Independently of whether the stand portals are arranged at a narrow or a larger distance behind one another in the passage direction, the stand portals jointly carry the continuous slide servicing the work stations which may be arranged in the area of the stand portals as well as between the portals. In this construction, in the area of the head pieces, neither a continuous longitudinal support nor a head piece which is continuous along the length of the slide is required.

This construction considerably reduces expenditures in comparison to press frames with continuous longitudinal supports in the head area without any loss of stability. This particularly applies to presses which are set up for processing relatively large sheet metal parts. With respect to presses with non-integrated or mutually separated press stations, both the constructional expenditures and the overall size are reduced; it is possible to move the individual press stations which are operated by the common slide very close together. This reduces the required length of the press and therefore the expenditures.

In the case of particularly large sheet metal parts, as in the manufacturing of double doors or side walls for passenger cars, the construction according to the invention permits, in a simple manner, combining of several press stations. Because of transport measurements and weights, individual head pieces and individual bedplates can otherwise span only one forming station. The arrangement of several press stations or forming stations under a common slide, however, is advantageous for reasons of cost and is permitted by the construction of the multistation press according to the invention. The number of cost-intensive operating parts, such as drive components, pressure points, slide guides, etc., can be reduced considerably. For example, two head pieces and four pressure points are sufficient for three press stations. In addition, no depositing devices for parts are required between the press stations or forming stations.

In the suggested solution, there is no increase in the unsupported span width of the head pieces or of the bedplates by the combination of several press stations or forming stations. The span width of the bedplate construction which is stressed with respect to bending is also significantly reduced in comparison to known solutions.

Although, in principle, a single eccentric would be sufficient for each head piece, it is advantageous for each head piece to have two eccentrics which are driven in opposite directions and which are connected with the slide by way of connecting rods. This results in a symmetrical distribution of force.

The slide may extend along two press stations. However, it is advantageous for the slide to operate at least three or more press stations together. This does not further increase the number of head pieces, guides, etc., so that the proportional costs per press station will be reduced.

The stand portals are separated from one another; this has the particular result that head pieces of the stand portals are not connected with one another or are connected with one another in the passage direction only under tension and pressure. Corresponding rods or struts can be mounted between the head pieces.

Preferably, the head pieces, which are disposed on the press stands standing on the basic supports, are tensioned by turnbuckles with respect to the press stands and the basic supports. In every phase of operation of the multistation press, the press stands will then transmit only pressure forces.

Particularly when the slide spans three or more than three press stations and the two stand portals are arranged at a distance from one another, it is advantageous for the longitudinally extending basic supports to be constructed as bending supports which transmit the forces of the press stations arranged between the stand portals to the adjacent press stations. This results in a particularly simple construction of the frame or body of the multistation press.

Other objects, advantages and novel features of the present invention will become apparent from the following detailed description of the invention when considered in conjunction with the accompanying drawings.

BRIEF DESCRIPTION OF THE DRAWINGS

The drawing illustrates one embodiment of the invention.

DESCRIPTION OF THE PREFERRED EMBODIMENTS

Figure 1:
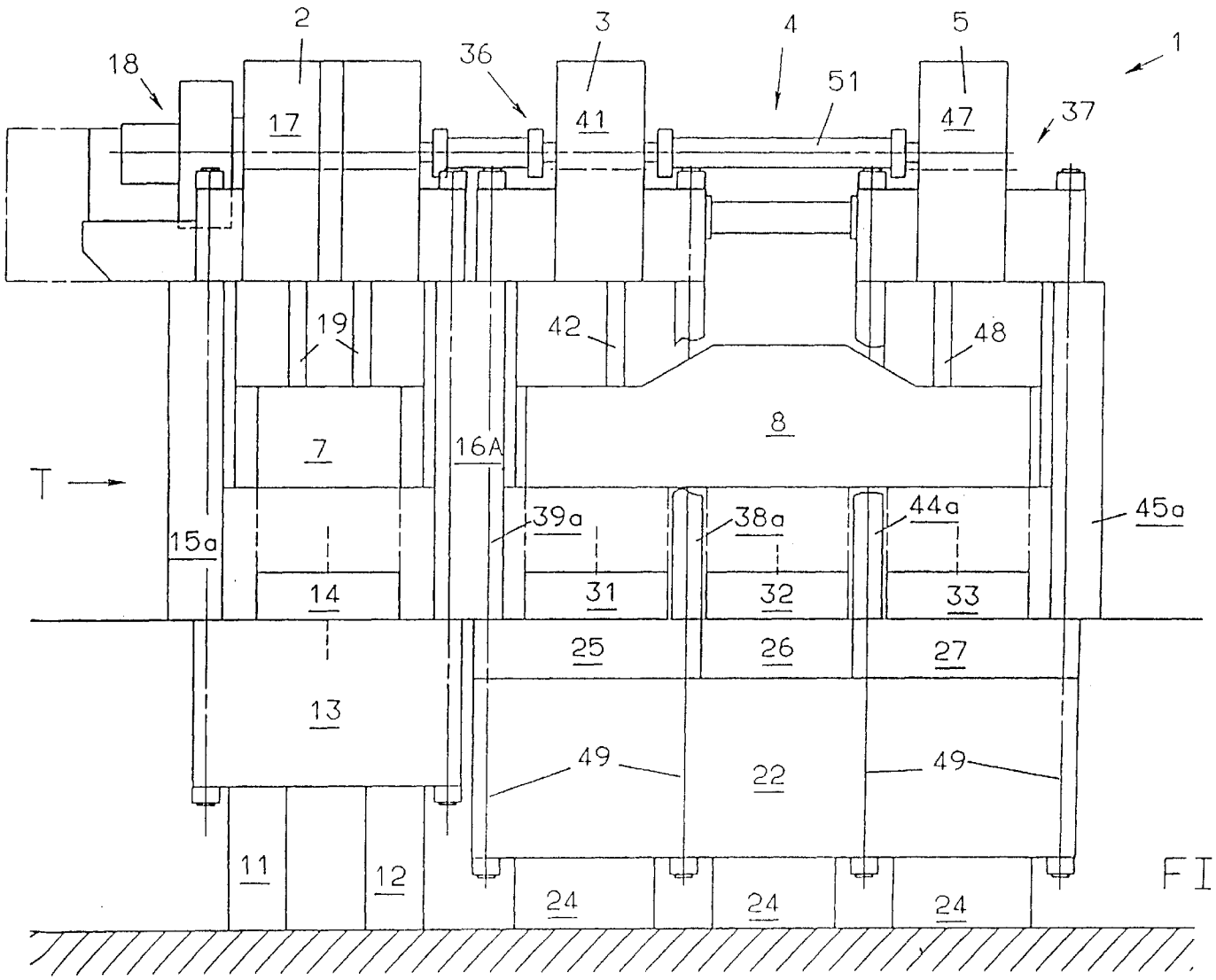
FIG. 1 is a schematic lateral view of a multistation press having several press stations operated by a single slide.
Figure 2:
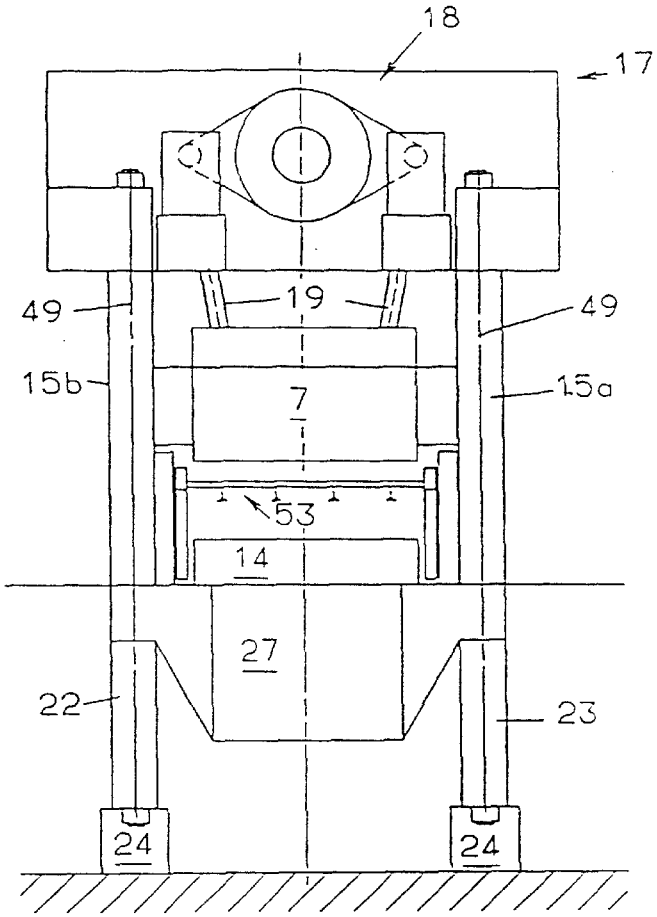
FIG. 2 is a schematic frontal view of the multistation press according to FIG. 1.
Figure 3:
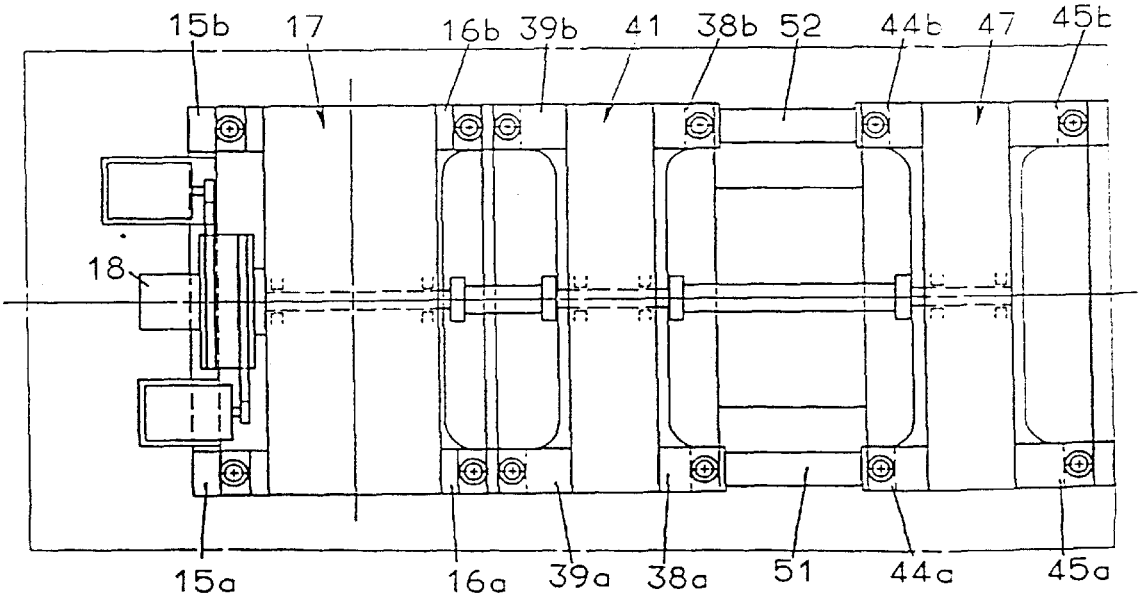
FIG. 3 is a schematic top view of the multistation press according to FIGS. 1 and 2.

FIG. 1 illustrates a multistation press 1 which has a drawing station 2 and three forming stations 3, 4, 5 which follow with respect to a passage direction T. While drawing station 2 has its own slide 7, the forming stations 3, 4, 5 have a common slide. The drawing station 2 has a bedplate 13 which is stationarily arranged by suitable supports or feet 11, 12 and on which a sliding table 14 is disposed below the slide 7. A total of four press stands 15*a*, 15*b*, 16*a*, 16*b* (FIG. 3) standing on the bedplate 13 carry a head piece 17. This head piece 17 rests on the press stands 15*a*, 15*b*, 16*a*, 16*b* and contains a main drive 18 which is illustrated only schematically and which, as illustrated in FIGS. 1 and 2, drives the slide 7 by way of connecting rods 19. These connecting rods 19 are applied to the slide 7 at pressure points 21 illustrated in FIG. 4.

The forming stations 3, 4, and 5, which follow the drawing station 2, form a constructional unit which is supported by two longitudinally extending basic supports 22 and 23 which, in turn, rest on pedestals 24. Bedplates 25, 26, and 27, which extend transversely, are placed on the basic supports 22, 23 and fastened. Each of the bedplates 25, 26, and 27, in turn, carries a sliding table 31, 32, and 33, respectively. The sliding tables 31, 32, and 33 are arranged below the slide 8 and are used for receiving corresponding bottom tools, in which case the respective pertaining top tools are to be fastened to the slide 8.

Figure 4:
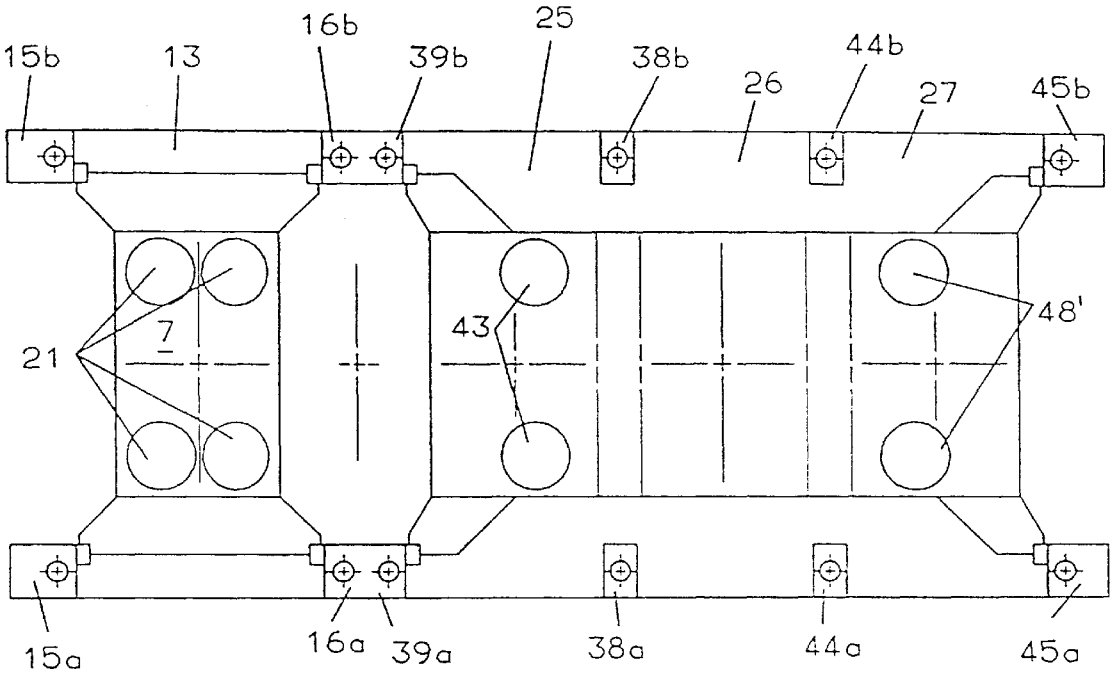
FIG. 4 is a schematic horizontal sectional view of the multistation press according to FIGS. 1 to 3.

On the basic supports 22, 23, which are connected with one another by bedplates 25, 26, 27 or on the bedplates 25, 27, two stand portals 36, 37 are set up. The stand portal 36 has press stands 38*a*, 38*b*, 39*a*, 39*b*. In this case, the press stands 39*a*, 39*b* can be combined to form a constructional unit with the press stands 16*a*, 16*b*. The total of four press stands 38*a*, 38*b*, 39*a*, 39*b* carry a head piece 41 which contains two eccentrics driven by the main drive 18. These eccentrics are connected with the slide 8 by way of two connecting rods 42 which define pressure points 43 on the slide 8 which are illustrated in FIG. 4. The press stands 38*a*, 38*b*, 39*a*, 39*b* are arranged such that the head piece 41 is arranged above the forming station 3. The head piece 41 does not project into the area of the adjacent forming station 4.

The second stand portal 37 is arranged at forming station 5 and contains four press stands 44*a*, 44*b*, 45*a*, 45*b*. The press stands 44*a*, 44*b*, 45*a*, 45*b* are disposed on the bedplate 27 and carry a head piece 47 which is part of the stand portal 37 and which is arranged above the bedplate 27 and does not project into the area of the forming station 4. Two eccentrics are arranged on the head piece 47 which are driven into two opposite directions by the main drive 18 and which are connected with the slide 8 by way of connecting rods 48. In this case, the connecting rods 48 run synchronously with the connecting rods 42 and define pressure points 48' on the slide 8 which are illustrated in FIG. 4.

The head pieces 41, 47 are tensioned by way of turnbuckles 49 with respect to the basic supports 22, 23. The turnbuckles 49, which are only outlined in the figures by dash-dotted lines, extend through the press stands 38, 39, 44, 45 and through the bedplate 25, 26, 27. The turnbuckles 49 are particularly used for absorbing the reaction force applied to the head piece 41, 47 which is generated during the drive of the slide 8 and during a press rotation is temporarily directed upwards. From the forming stations 3 and 5, these forces are introduced on the bedplate side into the basic supports 22, 23 and are transmitted directly by way of the tie rods 49 to the head pieces 41, 47. The conditions are different in the case of forming station 4 which is arranged between the stand portals 36, 37. By means of the pressure force, the slide 8 is stressed here with respect to bending, in which case it can have a stronger construction in the area of the forming station 4. The bedplate 26 transmits half the corresponding reaction force in each case along short paths by way of the turnbuckles 49 to the head pieces 41, 47 so that the basic supports 22, 23 are stressed with respect to bending only along a short distance. The required resistance to bending can therefore be implemented relatively easily.

As required, one or two struts 51, 52 may be provided between the head pieces 41, 47 and are essentially only under tension and/or pressure. These struts 51, 52 relieve the basic supports 22, 23 with respect to their bending strain. However, the struts 51, 53 themselves are not under any bending strain. They may be screwed to the head pieces 41, 47 or otherwise connected with them.

The basic structure of the press frame of the forming stations 3, 4, 5 is defined by the two stand portals 36, 37 arranged at a distance from one another, arranged on two longitudinally extending basic supports and bridging the basic supports 22, 23 in the transverse direction. Below the stand portals 36, 37, bedplates 25, 27 are arranged which also bridge the basic supports 22, 23. As required, another bedplate 26 may be arranged between two stand portals 36, 37 which also bridges the basic supports 22, 23 in the transverse direction. Independently thereof, the head pieces 41, 47 of the stand portals 36, 37 jointly guide a single slide 8 which is assigned to all forming stations 3, 4, 5. This basic structure results in a stable stand with elements which are only stressed slightly with respect to bending and which makes it possible to construct multistation presses for large vehicle body parts with compact constructions not requiring continuous head pieces.

In operation of the multistation press described above, the slides 7 and 8 illustrated in FIG. 1 swing synchronously up and down, in which case, sheet metal parts are transferred in a timed manner by a transfer system 53 symbolically illustrated in FIG. 2. Metal sheets first placed in the drawing station 2 are deep-drawn there and are transferred to the forming station 3 for further forming. After each press stroke, the sheet metal part is transported one forming station farther.

Each of the forming stations 3, 4, and 5 which follows the drawing station 2 requires lower operating forces than the drawing station 2. This achieves loading of the connecting rods 42, 48 as well as of the eccentric devices correspondingly driving them which is, on the whole, of the same magnitude as the loading of the driving device of the drawing station 2.

The pressure points 43, 48 are arranged on the slide 8 such that its bending stress becomes minimal. This is achieved by having the pressure points 43, 48' not arranged precisely at the ends of the slide 8 or at the centers of the forming stations 3, 5 but instead offset slightly toward the forming station 4 situated between the stations 3 and 5.

In a large-part transfer press 1, several forming stations 3, 4, 5 are arranged under a common slide 8 in order to reduce cost. The bedplate construction consists of two longitudinal or basic supports 22, 23, on which, in each case, one bedplate 25, 26, 27 for each forming station 3, 4, 5 is placed transversely and is fastened as required. The drive of the slide 8 takes place by way of two mutually independent head pieces 41, 47. According to the number of stations, the head pieces 41, 47 are arranged side-by-side with or without a distance from one another, and each of the head pieces spans only one of the forming stations 3, 5.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Multistation press for forming sheet metal parts for a vehicle body comprising:

at least two stand portals having press stands and at least two head pieces carried by the press stands, at least one common and continuous slide extending in a passage direction along at least two press stations and disposed to move back and forth, the head pieces being used for driving the slide with a back-and-forth movement, and two basic supports carrying at least one bedplate, which is arranged below the slide, as well as the press stands, wherein the basic supports are arranged along the passage direction at a distance, parallel to one another, and extend over a whole length of the press stations along which the slide extends in said passage direction, and wherein the slide is carried by said at least two stand portals which are disposed independently of one another on the two basic supports and each of the head pieces operates synchronously with respect to one another.

2. Multistation press according to claim 1, wherein the press stations which have the common and continuous slide have separate bedplates which rest in the transverse direction on the basic supports.

3. Multistation press according to claim 1, wherein each head piece has at least two eccentrics which are driven in opposite directions, and further comprising connecting rods by which the at least two eccentrics are connected with the slide.

4. Multistation press according to claim 1, wherein the slide extends along at least three of said press stations.

5. Multistation press according to claim 1, wherein the head pieces of the stand portals are connected only such that no continuous bending support is constructed in a longitudinal direction of the press which is defined by the passage direction.

6. Multistation press according to claim 5, wherein the head pieces are connected with one another by at least one pressure-resistant element which is only subjected to tension and pressure.

7. Multistation press according to claim 1, and further comprising turnbuckles extending from the basic supports by way of the press stands to the head pieces, said turnbuckles tensioning the head pieces, the press stands and the basic supports with respect to one another.

8. Multistation press according to claim 4, wherein the basic supports are constructed as bending supports which transmit forces emanating from one of the press stations bridged by the slide to adjacent press stations.

9. Multistation press according to claim 1, wherein each stand portal spans only one press station.

10. Multistation press according to claim 1, wherein each stand portal has four press stands and each of the press stands has at least one turnbuckle.

11. Multistation press according to claim 1, wherein the head pieces of the stand portals are not connected with one another.

12. Multistation press for forming sheet metal parts comprising:

a slide extending through and driven in at least two press stations, basic supports arranged parallel to one another and extending throughout combined lengths of the press stations in which the slide is driven, at least two stand portals disposed independently of each other on said basic supports which bear and guide the slide, a head piece included in each of said stand portals and driving the slide back and forth, at least one bedplate used to receive tools and carried by said basic supports below the slide, and press stands, disposed on the bedplate, which carry each head piece.

13. Multistation press according to claim 12, wherein each of the press stations has a separate bedplate resting on the basic supports.

14. Multistation press according to claim 12, and further comprising at least two eccentrics driven in opposite directions provided on each head piece and connecting rods connecting the eccentrics with the slide.

15. Multistation press according to claim 12, wherein the slide extends through at least three of said press stations.

16. Multistation press according to claim 12, wherein each head piece is one of a pair of head pieces lacking continuous bending support in the passage direction.

17. Multistation press according to claim 16, and further comprising at least one pressure-resistant element which is subjected only to tension and pressure connecting said head pieces.

18. Multistation press according to claim 12, and further comprising turnbuckles interconnecting the head pieces, the press stands and the basic supports with one another.

19. Multistation press according to claim 15, wherein the basic supports are bending supports which transmit forces emanating from one of the press stations bridged by the slide to adjacent press stations.

* * * * *